US010578342B1

(12) United States Patent
Moromisato

(10) Patent No.: US 10,578,342 B1
(45) Date of Patent: Mar. 3, 2020

(54) ENHANCED COMPRESSION REFRIGERATION CYCLE WITH TURBO-COMPRESSOR

(71) Applicant: Ricardo Hiyagon Moromisato, Surrey (CA)

(72) Inventor: Ricardo Hiyagon Moromisato, Surrey (CA)

( * ) Notice: Subject to any disclaimer, the term of this patent is extended or adjusted under 35 U.S.C. 154(b) by 0 days.

(21) Appl. No.: 16/170,126

(22) Filed: Oct. 25, 2018

(51) Int. Cl.
*F25B 7/00* (2006.01)
*F25B 11/04* (2006.01)
*F25B 39/00* (2006.01)
*F25B 39/04* (2006.01)

(52) U.S. Cl.
CPC ..... *F25B 7/00* (2013.01); *F25B 11/04* (2013.01); *F25B 39/00* (2013.01); *F25B 39/04* (2013.01); *F25B 2339/041* (2013.01)

(58) Field of Classification Search
CPC ..... F25B 7/00; F25B 11/04
USPC ..... 62/335
See application file for complete search history.

(56) References Cited

U.S. PATENT DOCUMENTS 4,000,778 A * 1/1977 Laing ..... F24F 12/002 165/86
4,524,587 A * 6/1985 Kantor ..... F01K 11/04 62/101
5,644,928 A * 7/1997 Uda ..... A63C 19/10 62/402
5,878,808 A * 3/1999 Rock ..... F04D 25/04 165/104.25
6,170,272 B1 * 1/2001 Backman ..... F25B 5/02 62/117
6,530,234 B1 * 3/2003 Dobak, III ..... A61B 18/02 62/52.1
6,672,088 B2 * 1/2004 Ueda ..... F16K 3/262 251/31
7,703,296 B2 * 4/2010 Jang ..... F25B 7/00 62/335
8,261,565 B2 * 9/2012 Borror ..... F25B 23/006 62/113
8,316,655 B2 * 11/2012 Adler ..... F25B 3/00 62/402
8,505,317 B2 * 8/2013 Ascani ..... F25B 1/053 62/115
9,016,083 B2 * 4/2015 Okuda ..... F25B 9/004 62/402
9,664,200 B2 * 5/2017 Oda ..... F04D 29/063
2007/0144192 A1 * 6/2007 Kidwell ..... F25B 3/00 62/209
2007/0144201 A1 * 6/2007 Matsumoto ..... B60H 1/323 62/335

(Continued)

*Primary Examiner* — Filip Zec

(57) ABSTRACT

This invention aims to dramatically reduce the use of electricity in refrigeration equipment by reusing the energy, otherwise rejected, in conventional refrigeration units. This enhancement compression refrigeration cycle would revolutionize the refrigeration industry and would be conducive to a lesser carbon footprint impact on global warming. It consists of 3-fluid Loops that would maximize the use of the heat from conditioned or refrigerated room that gets expelled into the environment by conventional refrigeration units, thereby channeling this energy to improve the efficiency of refrigeration/air conditioning machinery by utilizing expelled energy that would otherwise be wasted.

3 Claims, 4 Drawing Sheets

DRAWING TITLE: Enhanced Compression Refrigeration Cycle with Turbo-compressor (Schematic)

(56) References Cited

U.S. PATENT DOCUMENTS

| | | | | |
|---|---|---|---|---|
| 2011/0289953 | A1* | 12/2011 | Alston | B60H 1/32<br>62/238.6 |
| 2018/0363960 | A1* | 12/2018 | Kniffler | F25B 25/005 |
| 2019/0017730 | A1* | 1/2019 | Matsukura | F25B 1/053 |

* cited by examiner

DRAWING TITLE: Current Compression Refrigeration Cycle (Schematic)

DRAWING TITLE: Enhanced Compression Refrigeration Cycle with Turbo-compressor (Schematic)

DRAWING TITLE: Dual coaxial Heat Exchanger

TOP VIEW

1 - 1 CROSS SECTION

DRAWING TITLE: Turbo - compresser

FRONT VIEW

1 - 1 SECTION

2 - 2 SECTION

3 -3 SECTION

ENHANCED COMPRESSION REFRIGERATION CYCLE WITH TURBO-COMPRESSOR

BACKGROUND OF THE INVENTION

Currently air conditioning equipment in buildings is one of the largest consumers of electricity in our cities. Similarly, refrigeration equipment for storing foods, medicines and other items requiring below ambient temperatures, is also very large consumer of electricity.

The present compression refrigeration cycle, which is the most common system, has 4 stages (See drawing 1/4).

Stage 1—Expansion: A liquid refrigerant at high pressure, coming from the condenser, flows through a metering device, lowering its pressure and expanding in the next stage, evaporation.

Stage 2—Evaporation: In the evaporator the refrigerant in liquid state and low pressure starts changing to vapor state with the help of the heat from the surrounding warm air pulled by a circulating fan, or by another warm fluid in a heat-exchanger.

Stage 3—Compression: A refrigeration compressor pulls the vaporized and warmed refrigerant from the evaporator and compresses it to a pressure high enough so the refrigerant, due its properties, raise its temperature above the cooling medium (air, water or others) of the condenser. Hence in this way, the heat collected by the refrigerant can be rejected to the cooling medium.

Stage 4—Condensation: After the refrigerant temperature raises as the pressure is elevated by the compressor, the refrigerant in hot vapor state, is sent to the condenser. From here, the heat gained by the refrigerant in the evaporator, plus the heat gained during the work of compression, is rejected to the cooling medium (air, water or others), thus changing its state to liquid. After that, the liquid refrigerant at high pressure and ambient temperature, will go through the metering device and starts a new cycle.

With the present compression refrigeration system, one compressor using one Kw of power approximately, as an example, could be used to remove 12,000 Btu of heat per hour from a conditioned or refrigerated room. That means that per each Kw of compressor power applied to the system, it can reject 12,000 Btu/hr (or 3.51 Kw) plus 1 Kw (from the heat of compression) to the atmosphere, making it a total of 4.51 Kw. This refrigeration machine output could be interpreted as being 4.51 Kw, where the input is only one Kw. In other words, the output is 4.51 times the input, which looks rare. In fact, the rejected 4.51 Kw already includes the heat removed from the conditioned or refrigerated space. That rejected heat is the key point of this invention; its main purpose is to use the energy, which is usually rejected as part of a normal process of refrigeration, and thus generate more cooling capacity, with little increase in electricity use.

BRIEF SUMMARY OF THE INVENTION

The core of the invention is to maximize the use of the heat, currently rejected to the atmosphere, from each refrigeration machine in order to power a turbo-compressor which would generate more cooling capacity, thereby reducing the use of electricity. In order to achieve this purpose, the current stage of condensation of the compression refrigeration cycle must be done by a double coaxial heat-exchanger, where the heat of rejection would be transferred to another refrigerant in a closed loop "B". This heat would make the latter refrigerant reach high temperature and therefore high pressure, which would also be able to generate a rotational movement in a turbine. Then a refrigeration compressor linked to the turbine, using the same shaft in an independent chamber, would pull another refrigerant "C", from an evaporator, part of another refrigeration Loop "C", generating more cooling capacity, thanks to the turbo-compressor. Furthermore, the rejected heat of the refrigeration effect from the Loop "C", transferred to Loop "B", using the same dual coaxial heat-exchanger mentioned above, would provide an additional capacity of the combined cooling capacity of Loops "A" and "C".

BRIEF DESCRIPTION OF THE SEVERAL VIEWS OF THE DRAWINGS

Drawing 1/4: This drawing is a schematic representation of the current compression refrigeration cycle. The schematic shows the relationship between the metering device (Expansion stage), evaporator (evaporation stage), compressor (compression stage) and the condenser (condensation stage).

Drawing 2/4: This drawing is, also an schematic, the enhanced compression refrigeration cycle. It shows the 3 closed Loop of refrigerants.

Figure 1:
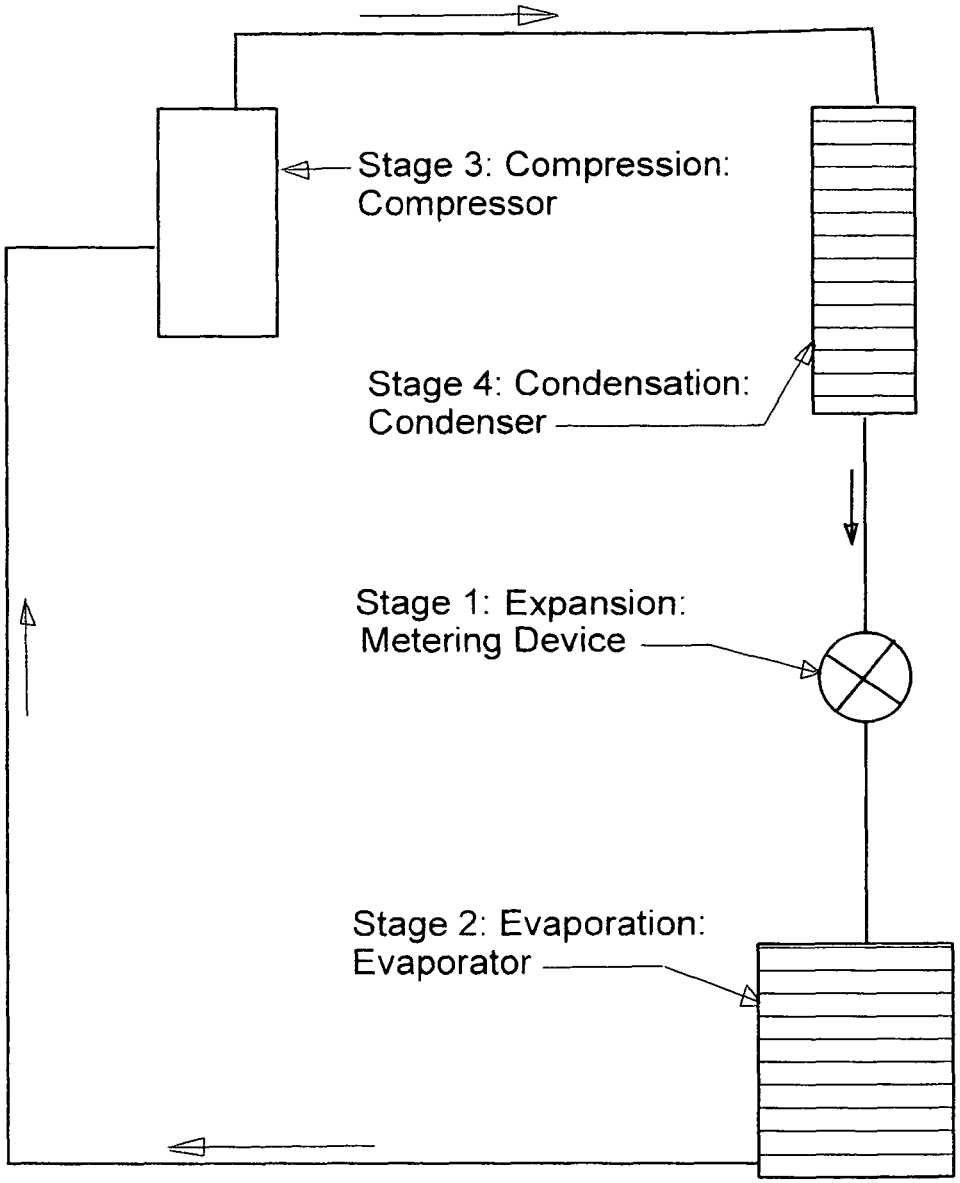
Figure 2:
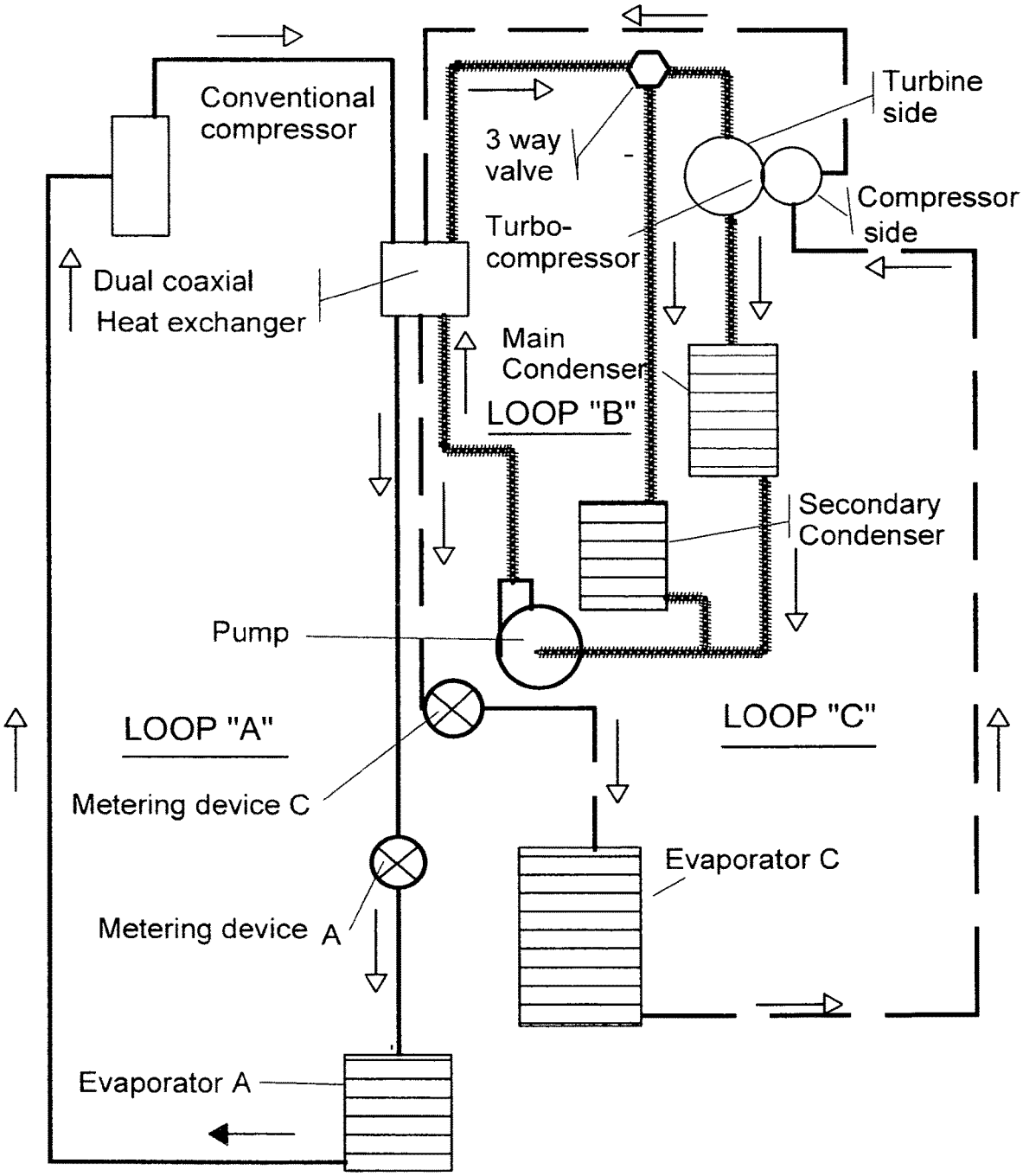
Figure 3:
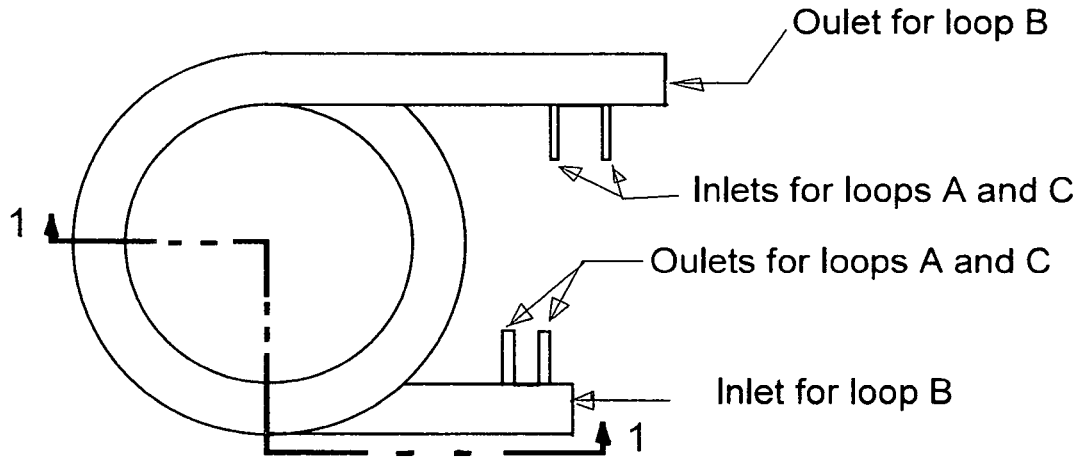
Figure 3:
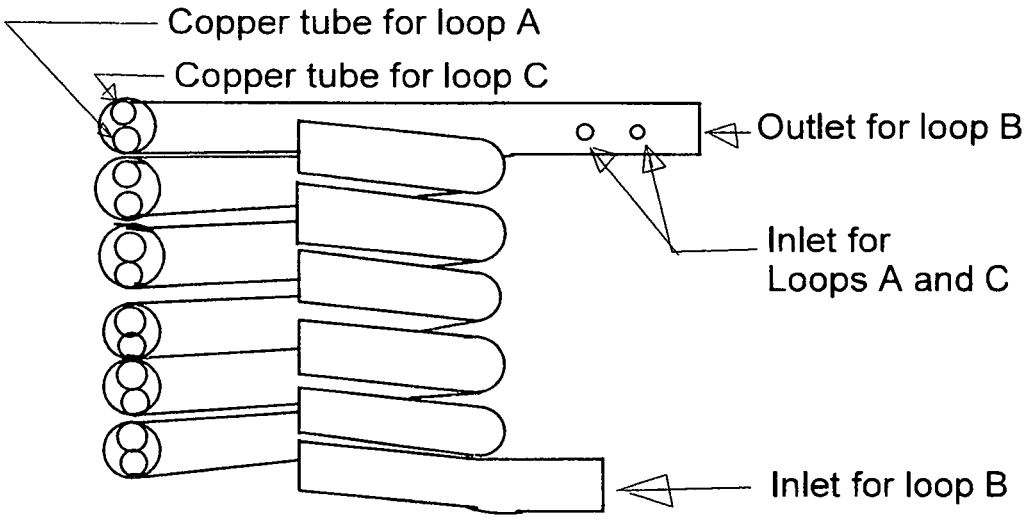
Figure 4:
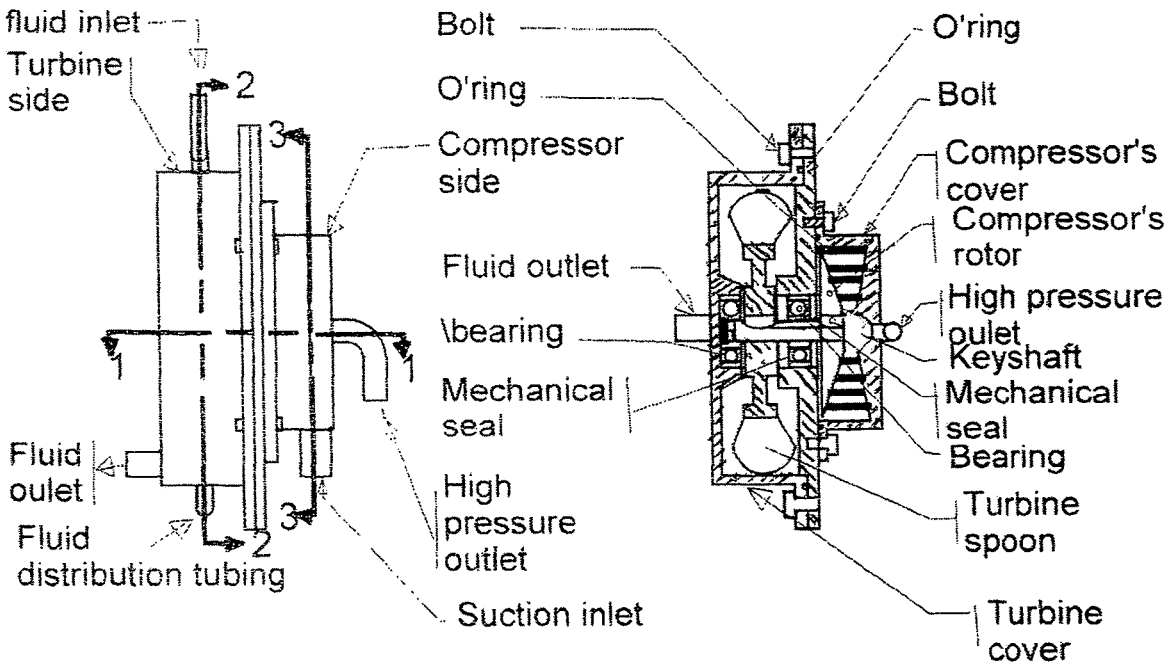
Figure 4:
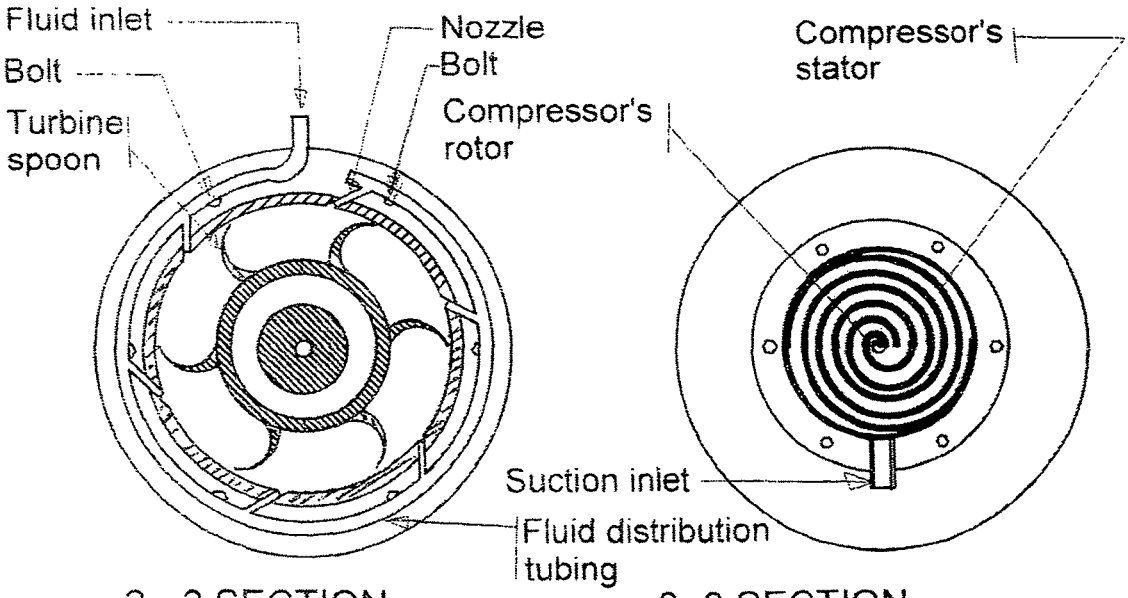

Loop "A" is a regular compression refrigeration cycle where the condenser has been replaced by the dual coaxial heat-exchanger in order to transfer all the heat of rejection to the second loop "B".

Loop "B" includes the turbo-compressor, to be powered by the hot and high-pressure refrigerant which received the heat from Loop "A", the 3 way valve and the recirculating pump.

Loop "C" is similar to a standard compression refrigeration cycle, with different compressor and condenser. It includes the mechanically powered compressor, part of the turbo-compressor from Loop "B", and the condenser is also replaced by the same dual coaxial heat-exchanger used in the loop "A".

Drawing 3/4: Dual Coaxial Heat-exchanger: This is the representation of the Dual Coaxial Heat-exchanger to transfer heat from the conventional compression refrigeration system (Loop "A") and from the loop "C" to a loop "B" in order to use the energy, otherwise to be rejected, to generate more cooling capacity, with the loop "C".

Drawing 4/4: Turbo-compressor: This drawing shows the Front View of the apparatus and 3 cross sections 1-1, 2-2 and 3-3 to show the inside parts of the turbo-compressor required in the enhanced compression refrigeration cycle.

DETAILED DESCRIPTION OF THE INVENTION

This invention is an enhanced compression refrigeration cycle with a turbo-compressor in 3 closed refrigerant loops. The improvement to the current compression refrigeration cycle is the use of the heat of rejection from any standard compression refrigeration system to power a turbine, which at the same time, would power a refrigeration compressor, generating more cooling capacity and therefore reducing significantly, the use of electricity. Please see drawing 2/4.

All the refrigeration equipment, including air conditioning systems, must reject the heat, collected from removing it from the conditioned or refrigerated room, usually to the environment. As per the first law of Thermodynamics, the conservation of energy, the refrigeration system can not destroy the heat, that is why the heat is usually moved outside of the building and rejected to the air.

As explained in the background of the invention (paragraph 0007), a one Kw refrigeration compressor, for example, can remove about 12,000 Btu of heat per hour from a conditioned or refrigerated room; this heat is equal to 3.51 Kw. Then, because the heat generated by the compressor must also be rejected to the atmosphere, the total heat rejected per hour is about 4.51 Kw. From the example, the 4.51 Kw is the gross power that could be used, considering all the friction loss, to move a turbine and a refrigeration compressor to generate more cooling capacity.

The way the enhanced compression refrigeration cycle would use the heat of rejection is by changing the regular condenser on the condensation stage for a dual coaxial heat-exchanger, where the hot refrigerant in Loop "A" at high pressure transfers the heat in counter flow to another Refrigerant "B" in a closed loop. (See drawing 2/4). Refrigerant "B", after receiving the heat from hot Refrigerant "A" would be directed to a turbo-compressor, after passing by a 3-way valve, which would be used as a means to control the additional cooling capacity generated by the enhanced compression refrigeration cycle.

Dual coaxial heat-exchanger: This new component in the refrigeration equipment, is similar to what is available in the market, except that this unit has 2 tubes (instead of one) inside the steel tube. It would be made on steel tube with 2-copper tubing with fins (See drawing 3/4). The steel tube and the 2-copper tube would be bended together to form spiral shape, with several turns, depending on the capacity to transfer heat. At both ends of the spiral, the steel tube would have a copper terminal to hook up the copper tubing for Refrigerant "B". The 2-copper tube ends would also have terminals to connect to the tubing for loops "A" and "C". For the efficiency of the heat exchanger, the connexions must be made in counter flow. The 2 hot gas tubing from Loops "A" and "C" would enter the dual coaxial heat exchanger on the same side where Loop "B" would come out. A good insulation is also required for the heat exchanger to reduce the heat loss to the surrounding area. This heat exchanger would allow to transfer heat from the standard compression refrigeration cycle (Loop "A") and also from the turbo compressor from the loop "C".

Turbo compressor: This is also a new component in the refrigeration industry. This is a basic part for the enhanced compression refrigeration cycle (See drawings 2/4 and 4/4). One side of the turbo-compressor is a turbine and the other side is the refrigeration compressor, on the same shaft and independent chambers. The turbine could be using the Pelton type (for most cases) or Rankine type (for very large units). The turbine uses the kinetic energy of the hot refrigerant, at high pressure, to generate a rotational movement of the turbine. On the case of the Pelton type the drawing show nozzles to convert the pressure in kinetic energy that would move the turbine. On the other side of the turbine, the refrigeration compressor would be able to pull the refrigerant in vapor stage from the evaporator "C" and compress it to a pressure high enough to allow a good heat transfer to the dual coaxial heat-exchanger. The compressor rotor is shaped from the Archimedean Spiral, with decreasing internal volume from the perimeter to the center of the compressor, where the high-pressure outlet would be located. The suction inlet would be located on the perimeter of the compressor side of the turbo-compressor.

Fluids: For simplicity reasons, the enhanced compression refrigeration cycle would be using the same fluid in all 3 loops. This would avoid contamination problems if the system used different refrigerants.

The 3-way Valve: This valve included in Loop "B" must be able to have several stages of closing, in order to allow a variable cooling capacity from the turbo-compressor. One of the outlets side of the valve would go to the turbine and the other would go to a regular condenser to change to a liquid state and reject the heat to the atmosphere. When the controls of the system require a full capacity, the 3-way valve would give the full flow to the turbine. If the demand for cooling is reduced, the 3-way valve should be reducing the flow of refrigerant to the turbine, therefore reducing the cooling capacity.

Detailed description of Loop "A": Loop "A" is a conventional compression refrigeration cycle which uses a regular metering device, a conventional evaporator and a standard electric compressor. Instead of a regular condenser, Loop "A" has a Dual Coaxial Heat exchanger (see drawings 2/4 and 3/4). Instead of rejecting the heat to the atmosphere, with a regular condenser, the heat is transferred to another refrigerant using the dual coaxial heat-exchanger.

Detailed description of Loop "B": With the rejected heat transferred from Loop "A", Refrigerant "B" goes through the 3-way valve, then through the turbine of the turbo-compressor, and then to a condenser to convert the latter to liquid at low pressure. The other leg of the 3-way valve would go to a regular condenser to change to liquid. The 3-way valve with several stages of closing would function as a capacity control of the turbo-compressor. It is expected that if the full capacity of the system must be decreased according the outdoor temperature and the heat load. This 3-way valve would be very important to achieve smooth transition from full capacity to nil capacity. The turbo compressor would be the second stage compressor of the refrigeration system. It is also expected that the heat of rejection of the loop "C" would add to the total cooling capacity of the enhanced compression refrigeration cycle. If the cooling demand decreases, the electric compressor of Loop "A" could be turned off, leaving only the turbo-compressor generating the cooling capacity required. Loop "B" also includes a positive displacement pump to pull the liquid refrigerant from the condensers, to provide enough pressure to push Refrigerant "B" through the dual coaxial heat-exchanger.

Detailed description of Loop "C": The refrigeration compressor of the turbo-compressor would be part of Loop "C" which is another refrigeration cycle with a regular metering device, standard evaporator, and the condenser replaced by the use of the same dual coaxial heat-exchanger in Loops "A" and "B" in counterflow, compared with the refrigerant flow in Loop "B".

In summary, this enhanced compression refrigeration cycle would have 3 closed refrigerant loops as shown in drawing 2/4. Loop "A" would look like a regular compression refrigeration cycle, using an electric-powered compressor, a metering device, an evaporator and instead of a regular condenser, it would use the dual coaxial heat-exchanger to transfer the heat of rejection to Refrigerant "B", in Loop "B". Then Refrigerant "B" at high pressure and high temperature would power the turbo-compressor which would generate more cooling capacity in Loop "C". Loop "C" would also look like a conventional compression refrigeration cycle, except that the compressor is not electrically powered and the condenser is the same dual coaxial heat-exchanger used in Loop "A".

The invention claimed is:

1. An enhanced compression refrigeration cycle comprising three fluid loops and a turbo-compressor, wherein a first fluid loop comprises an electric-powered vapor compressor;

a dual coaxial heat exchanger in fluid communication with the compressor; a first expansion valve in fluid communication with the dual coaxial heat exchanger; and a first evaporator, said first evaporator creating a cooling effect in rooms and in fluid communication with the first expansion valve on one side and in fluid communication with the compressor on another side; wherein a second fluid loop comprises a 3-way valve, said 3-way valve in fluid communication with the dual coaxial heat exchanger; a main condenser, said main condenser in fluid communication with the 3-way valve; a turbine in fluid communication with the 3-way valve, said turbine being a part of the turbo-compressor; a secondary condenser, said secondary condenser in fluid communication with the turbine; a pump configured to pull a liquid fluid from both the main condenser and the secondary condenser and in fluid communication with the coaxial heat exchanger; wherein a third loop comprises a compressor, said compressor being a part of the turbo-compressor and in fluid communication with the dual coaxial heat exchanger; a third expansion valve, said third expansion valve in fluid communication with the dual coaxial heat exchanger; and a third evaporator, said third evaporator generating another cooling effect in rooms and in fluid communication with the third expansion valve and the compressor.

2. The enhanced compression refrigeration cycle of claim 1, wherein the dual coaxial heat exchanger comprises two copper tubes inside of a steel tube, said two copper tubes being coiled in a plurality of bends, wherein the two copper tubes and the steel tube are fluidly isolated, wherein the two copper tubes have respective inlets at a top of the dual heat exchanger and respective outlets at a bottom of the dual heat exchanger; wherein the steel tube comprises an inlet at the bottom of the dual heat exchanger and an outlet at the top of the dual heat exchanger, providing for a counter-flow heat transfer; wherein each of the first fluid loop and the third fluid loop comprise said two copper tubes, while the second fluid loop comprises the steel tube.

3. The enhanced compression refrigeration cycle of claim 1, wherein the turbo-compressor comprises an impulse turbine connected mechanically via a common shaft to a scroll compressor, the turbine comprising a plurality of nozzles in a turbine housing to allow a second fluid at high pressure to rotate the turbine; wherein the turbine housing is separate from a compressor housing; wherein a manifold connects the plurality of nozzles to allow a uniform flow distribution of the second at high pressure and temperature; wherein the turbine housing comprises a second fluid outlet; wherein the compressor housing comprises a third fluid inlet for a third fluid in vapor state, at low pressure and low temperature; wherein the compressor housing comprises a third fluid outlet for the third fluid at high pressure and high temperature.

* * * * *